US010345730B2

(12) United States Patent
Yano et al.

(10) Patent No.: US 10,345,730 B2
(45) Date of Patent: Jul. 9, 2019

(54) LIGHT EMITTING DEVICE, OPTICAL WRITE-IN DEVICE, AND IMAGE FORMING DEVICE

(71) Applicant: KONICA MINOLTA, INC., Chiyoda-ku, Tokyo (JP)

(72) Inventors: So Yano, Ibaraki (JP); Masayuki Iijima, Okazaki (JP); Takahiro Matsuo, Toyokawa (JP); Takaki Uemura, Seto (JP); Akira Taniyama, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 368 days.

(21) Appl. No.: 15/282,889

(22) Filed: Sep. 30, 2016

(65) Prior Publication Data

US 2017/0115592 A1 Apr. 27, 2017

(30) Foreign Application Priority Data

Oct. 27, 2015 (JP) ..... 2015-210435

(51) Int. Cl.
*G03G 15/043* (2006.01)
*G03G 15/04* (2006.01)

(52) U.S. Cl.
CPC . *G03G 15/04054* (2013.01); *G03G 15/04063* (2013.01)

(58) Field of Classification Search
CPC ..... G03G 15/04054; G03G 15/04063
See application file for complete search history.

(56) References Cited

U.S. PATENT DOCUMENTS 8,399,766 B2 3/2013 Hane et al.
2009/0122129 A1* 5/2009 Tsujino ..... B41J 2/45 347/238

FOREIGN PATENT DOCUMENTS

JP 2005329634 A 12/2005
JP 2010200514 A 9/2010

* cited by examiner

*Primary Examiner* — Minh Q Phan
(74) *Attorney, Agent, or Firm* — Holtz, Holtz & Volek PC

(57) ABSTRACT

A light emitting device configured to cause a series circuit in which an OLED is connected to a thin film transistor to emit light by applying a predetermined voltage to the thin film transistor includes: a forward direction voltage estimating unit configured to estimate a forward direction voltage in a case where the OLED is caused to emit light at a set light quantity; a driving current amount estimating unit configured to estimate a driving current amount required for causing the OLED to emit light at the set light quantity; a source-drain voltage calculating unit configured to calculate a source-drain voltage applied to the thin film transistor from the predetermined voltage and the forward direction voltage; and a gate-source voltage determining unit configured to determine a gate-source voltage of the thin film transistor corresponding to the source-drain voltage in a case where the driving current amount is a drain current.

19 Claims, 11 Drawing Sheets

| | | THE NUMBER OF OLED | | | | |
|---|---|---|---|---|---|---|
| | | 1 | 2 | 3 | ··· | 15,000 |
| SET LIGHT QUANTITY | FULL SPEED | L1f | L2f | L3f | ··· | L15000f |
| | HALF SPEED | L1h | L2h | L3h | ··· | L15000h |

FIG. 8A

| | | THE NUMBER OF OLED | | | | |
|---|---|---|---|---|---|---|
| | | 1 | 2 | 3 | ··· | 15,000 |
| SET LIGHT QUANTITY | A | $VelI_{00}$ | $VelI_{01}$ | $VelI_{02}$ | ··· | $VelI_{015000}$ |
| | B | $VelI_{10}$ | $VelI_{11}$ | $VelI_{12}$ | ··· | $VelI_{115000}$ |
| | C | $VelI_{20}$ | $VelI_{21}$ | $VelI_{22}$ | ··· | $VelI_{215000}$ |
| | D | $VelI_{30}$ | $VelI_{31}$ | $VelI_{32}$ | ··· | $VelI_{315000}$ |

FIG. 8B

TEMPERATURE=80°C
TEMPERATURE=20°C
TEMPERATURE=10°C
TEMPERATURE=0°C

| | | ACCUMULATED LIGHT EMITTING TIME | | | | |
|---|---|---|---|---|---|---|
| | | 0–50 | 50–100 | 100–150 | ··· | 950–1000 |
| SET LIGHT QUANTITY | A | $VelCC_{00}$ | $VelCC_{01}$ | $VelCC_{02}$ | ··· | $VelCC_{020}$ |
| | B | $VelCC_{10}$ | $VelCC_{11}$ | $VelCC_{12}$ | ··· | $VelCC_{120}$ |
| | C | $VelCC_{20}$ | $VelCC_{21}$ | $VelCC_{22}$ | ··· | $VelCC_{220}$ |
| | D | $VelCC_{30}$ | $VelCC_{31}$ | $VelCC_{32}$ | ··· | $VelCC_{320}$ |

FIG. 9A

| | | THE NUMBER OF OLED | | | | |
|---|---|---|---|---|---|---|
| | | 1 | 2 | 3 | ··· | 15,000 |
| SET LIGHT QUANTITY | A | $IdI_{00}$ | $IdI_{01}$ | $IdI_{02}$ | ··· | $IdI_{015000}$ |
| | B | $IdI_{10}$ | $IdI_{11}$ | $IdI_{12}$ | ··· | $IdI_{115000}$ |
| | C | $IdI_{20}$ | $IdI_{21}$ | $IdI_{22}$ | ··· | $IdI_{215000}$ |
| | D | $IdI_{30}$ | $IdI_{31}$ | $IdI_{32}$ | ··· | $IdI_{315000}$ |

FIG. 9B

TEMPERATURE=80°C

ACCUMULATED LIGHT EMITTING TIME

···

ACCUMULATED LIGHT EMITTING TIME

TEMPERATURE=20°C

ACCUMULATED LIGHT EMITTING TIME

TEMPERATURE=10°C

ACCUMULATED LIGHT EMITTING TIME

TEMPERATURE=0°C

| | | ACCUMULATED LIGHT EMITTING TIME | | | | |
|---|---|---|---|---|---|---|
| | | 0–50 | 50–100 | 100–150 | ··· | 950–1000 |
| SET LIGHT QUANTITY | A | $IdCC_{00}$ | $IdCC_{01}$ | $IdCC_{02}$ | ··· | $IdCC_{020}$ |
| | B | $IdCC_{10}$ | $IdCC_{11}$ | $IdCC_{12}$ | ··· | $IdCC_{120}$ |
| | C | $IdCC_{20}$ | $IdCC_{21}$ | $IdCC_{22}$ | ··· | $IdCC_{220}$ |
| | D | $IdCC_{30}$ | $IdCC_{31}$ | $IdCC_{32}$ | ··· | $IdCC_{320}$ |

LIGHT EMITTING DEVICE, OPTICAL WRITE-IN DEVICE, AND IMAGE FORMING DEVICE

The entire disclosure of Japanese Patent Application No. 2015-210435 filed on Oct. 27, 2015 including description, claims, drawings, and abstract are incorporated herein by reference in its entirety.

BACKGROUND OF THE INVENTION

Field of the Invention

The present invention relates to a light emitting device, an optical write-in device, and an image forming device, and relates to a technology of controlling a light quantity of a light emitting element driven by a current using a thin film transistor with a high accuracy.

Description of the Related Art

An electrophotographic image forming device includes an optical write-in device in order to form an electrostatic latent image on a surface of a photoreceptor uniformly charged. In order to respond to a demand for reducing a size of an image forming device, a scanning type optical write-in device using a laser diode as a light emitting source is switching with a line optical type optical write-in device in which micro-dot light emitting elements are arranged in a line shape. In addition, in the line optical type optical write-in device using a semiconductor light emitting diode (LED) as a light emitting element, a LED array and a driving circuit for controlling light emitting elements are formed on different substrates from each other. Therefore, currently, cost of the line optical type optical write-in device cannot be reduced.

On the other hand, use of an organic LED (OLED) as a light emitting element allows the LED array and the driving circuit to be formed on the same substrate, and therefore cost of the optical write-in device can be reduced.

Such an optical write-in device (OLED print head (OLED-PH)) performs optical write-in by lighting many (for example, 15,000) light emitting elements arranged in a main scanning direction. Therefore, unevenness in a light quantity among the light emitting elements generates unevenness in a concentration in the main scanning direction not only in an electrostatic latent image but also in a toner image, and an excellent image cannot be achieved.

In a display device using an OLED, a light quantity variation is allowable to 30%. On the other hand, in an OLED-PH, a high accuracy for the light quantity variation is required, and even a light quantity variation of less than 1% has to be corrected. In order to remove the light quantity variation, preferably, a light sensor is not used in order to take advantage of merits of an OLED that cost of the optical write-in device can be reduced.

Examples of a technology of removing unevenness in a light quantity of a light emitting element include the following conventional technology. That is, as illustrated in FIGS. 14A and 14B, first, in a write-in period, a current digital to analogue converter (DAC) causes a driving current Id for emitting light at a desired light quantity to forcibly flow in a thin film transistor (TFT) 1402 for controlling a driving current amount supplied to a light emitting element 1401, and a capacitor 1403 stores a potential difference Vdg generated between a drain terminal and a gate terminal in the TFT 1402.

In a light emitting period, the voltage Vdg stored in the capacitor 1403 is applied between the gate terminal and the drain terminal in the TFT 1402 to cause the light emitting element 1401 to emit light at a desired light quantity (for example, refer to JP 2010-200514 A).

A threshold voltage Vth of the TFT 1402 has an initial variation. In addition, the drain current Id of the TFT 1402 is almost proportional to the threshold voltage Vth. Therefore, even when a constant voltage Vdg is applied to the TFT 1402, the driving current Id supplied is varied, and the light quantity of the light emitting element 1401 is not constant.

With respect to this problem, according to this conventional technology, the capacitor 1403 stores the voltage Vdg for supplying the driving current Id for causing the light emitting element 1401 to emit light at a desired light quantity, and the voltage Vdg is applied to the TFT 1402 in the light emitting period, and therefore a light quantity variation of the light emitting element 1401 can be suppressed.

In another conventional technology, all light emitting elements are caused to emit light under the same condition in advance, a light quantity of each of the light emitting elements is stored, and a driving condition is corrected for each of the light emitting elements according to the stored light quantity (refer to JP 2005-329634 A). Due to this, even when there is a variation in a light emitting efficiency $\alpha$ among the light emitting elements, the driving condition is corrected, for example, a driving current of a light emitting element having a large light quantity is reduced, and a driving current of a light emitting element having a small light quantity is increased when the light emitting elements are caused to emit light under the same condition. Therefore, a light quantity variation can be suppressed.

However, of the above two conventional technologies, the first conventional technology has the following problem caused by an initial variation in a forward direction voltage Vel of an OLED and a Vsd-Id characteristic between a source-drain voltage Vsd of a TFT and a drain current Id thereof.

The forward direction voltage Vel of the OLED has an initial variation. Therefore, as illustrated in FIGS. 14A and 14B, even when a voltage Vdd applied to a series circuit of the light emitting element 1401 and the TFT 1402 is constant, the source-drain voltage Vsd applied to the TFT 1402 satisfies Vsd=Vdd−Vel to generate a variation.

As the Vsd-Id characteristic of a TFT, when the source-drain voltage Vsd is increased in a saturation region, the drain current Id is also increased unlike a bipolar transistor or the like. Therefore, when the source-drain voltage Vsd is varied, the drain current Id is also varied, and therefore the first conventional technology cannot remove the light quantity variation of the light emitting element 1401.

Of the above two conventional technologies, the second conventional technology also has a problem caused by a forward direction voltage Vel of an OLED. That is, the forward direction voltage Vel of the OLED not only has an initial variation but also has a large temporal variation, and therefore has a variation of the driving current Id as described above. Therefore, even when only a temporal variation of the light emitting efficiency $\alpha$ is corrected, the light quantity variation cannot be removed.

SUMMARY OF THE INVENTION

The present invention has been achieved in view of the above problems, and an object thereof is to provide a light emitting device, an optical write-in device, and an image forming device preventing a light quantity variation caused by a Vsd-Id characteristic of a TFT and a variation of a forward direction voltage Vel of an OLED.

To achieve the abovementioned object, according to an aspect, a light emitting device configured to cause a series circuit in which an OLED is connected to a thin film transistor to emit light by applying a predetermined voltage to the thin film transistor, reflecting one aspect of the present invention comprises: a forward direction voltage estimating unit configured to estimate a forward direction voltage in a case where the OLED is caused to emit light at a set light quantity according to a factor to change an element characteristic of the OLED; a driving current amount estimating unit configured to estimate a driving current amount required for causing the OLED to emit light at the set light quantity according to a factor to change an element characteristic of the OLED; a source-drain voltage calculating unit configured to calculate a source-drain voltage Vsd applied to the thin film transistor from the predetermined voltage and the forward direction voltage; and a gate-source voltage determining unit configured to determine a gate-source voltage Vgs of the thin film transistor corresponding to the source-drain voltage Vsd in a case where the driving current amount is a drain current Id according to a Vsd-Id characteristic representing a relation between the source-drain voltage Vsd of the thin film transistor and the drain current Id, wherein the light emitting device causes the OLED to emit light by applying the determined gate-source voltage Vgs to the thin film transistor.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein:

FIG. 8A is a diagram exemplifying an initial Vel table stored in the driving current correction unit in the ASIC, and FIG. 8B is a diagram exemplifying a Vel correction coefficient table stored in the driving current correction unit in the ASIC;

FIG. 9A is a diagram exemplifying an initial Id table stored in the driving current correction unit in the ASIC, and FIG. 9B is a diagram exemplifying an Id correction coefficient table stored in the driving current correction unit in the ASIC;

DESCRIPTION OF THE PREFERRED EMBODIMENTS

Hereinafter, embodiments of a light emitting device, an optical write-in device, and an image forming device of the present invention will be described with reference to the drawings. However, the scope of the invention is not limited to the illustrated examples.

[1] Structure of Image Forming Device

First, a structure of an image forming device according to the present embodiment will be described.

Figure 1:
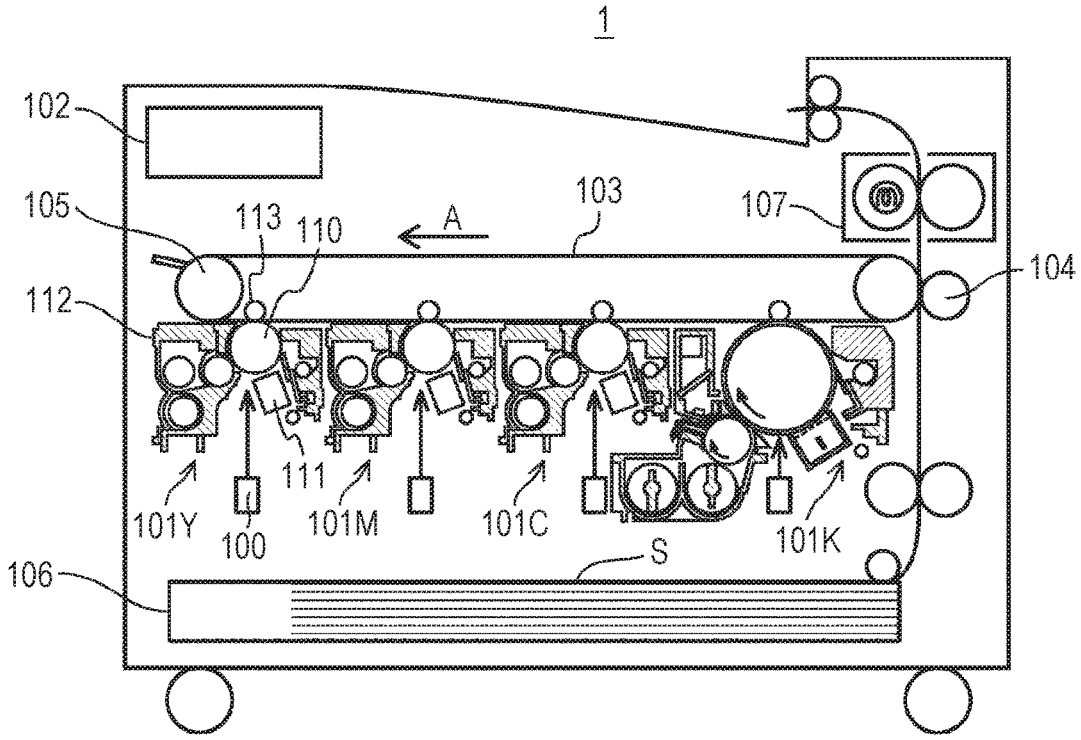
FIG. 1 is a view illustrating a main structure of an image forming device according to an embodiment of the present invention.

As illustrated in FIG. 1, an image forming device 1 is a so-called tandem type color printer. Image forming units 101Y, 101M, 101C, and 101K included in the image forming device 1 form toner images of yellow (Y), magenta (M), cyan (C), and black (K) under control by a controlling unit 102, respectively.

For example, in the image forming unit 101Y, a charging device 111 uniformly charges an outer peripheral surface of a photoreceptor drum 110. As described below, an optical write-in device 100 includes light emitting elements (OLEDs) arranged in a main scanning direction in a line shape, and causes each of the OLEDs to emit light according to a digital luminance signal generated by the controlling unit 102. Optical write-in is thereby performed on the outer peripheral surface of the photoreceptor drum 110, and an electrostatic latent image is formed.

A developing device 112 supplies a toner to the outer peripheral surface of the photoreceptor drum 110 to develop the electrostatic latent image (make the electrostatic latent image visible). A primary transfer roller 113 electrostatically transfers (primarily transfers) a toner image from the outer peripheral surface of the photoreceptor drum 110 to an outer peripheral surface of an intermediate transfer belt 103. The intermediate transfer belt 103 is stretched by a pair of secondary transfer rollers 104 and a driven roller 105, and rotates and travels in a direction of arrow A Similarly, the toner images of the colors MCK formed by the image forming units 101M, 101C, and 101K are primarily transferred to the outer peripheral surface of the intermediate transfer belt 103 such that the toner images of the colors MCK overlap with the toner image of the color Y to generate a color toner image. In accordance with conveyance of the color toner image to the pair of secondary transfer rollers 104 by the intermediate transfer belt 103, a recording sheet S supplied from a paper feeding cassette 106 is also conveyed to the pair of secondary transfer rollers 104.

The pair of secondary transfer rollers 104 electrostatically transfers (secondarily transfers) the toner image on the intermediate transfer belt 103 to the recording sheet S. The recording sheet S to which the toner image has been transferred is subjected to thermal fixing of the toner image in a fixing device 107, and then is discharged outside the device.

The recording sheet S which is thick paper requires a larger heat quantity for fixing the toner image than the recording sheet S which is plain paper. Therefore, the image forming device 1 switches a conveying speed (system speed)

of the recording sheet S according to the kind of paper of the recording sheet S. The image forming device 1 conveys plain paper at a full speed, and conveys thick paper at a half speed. A rotation speed of the photoreceptor drum 110 is also switched according to the system speed. Therefore, a difference is generated in exposure time per pixel.

[2] Structure of Optical Write-in Device 100

Next, a structure of the optical write-in device 100 will be described.

Figure 2:
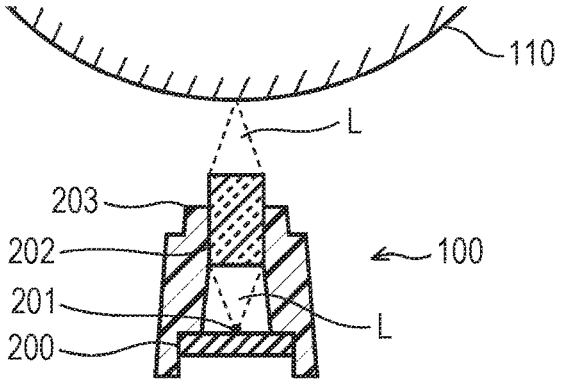
FIG. 2 is a cross sectional view for explaining an optical write-in action of an optical write-in device.

As illustrated in FIG. 2, the optical write-in device 100 includes an OLED panel 200 and a Selfoc lens array (SLA) 202 housed in a holder 203. An OLED 201 is mounted on the OLED panel 200. A light beam L emitted by the OLED 201 is condensed on an outer peripheral surface of the photoreceptor drum 110 by the Selfoc lens array 202. A micro lens array (MLA) may be used in place of the SLA. A cable or the like for connection to necessary portions of the image forming device 1 is not illustrated.

Figure 3:
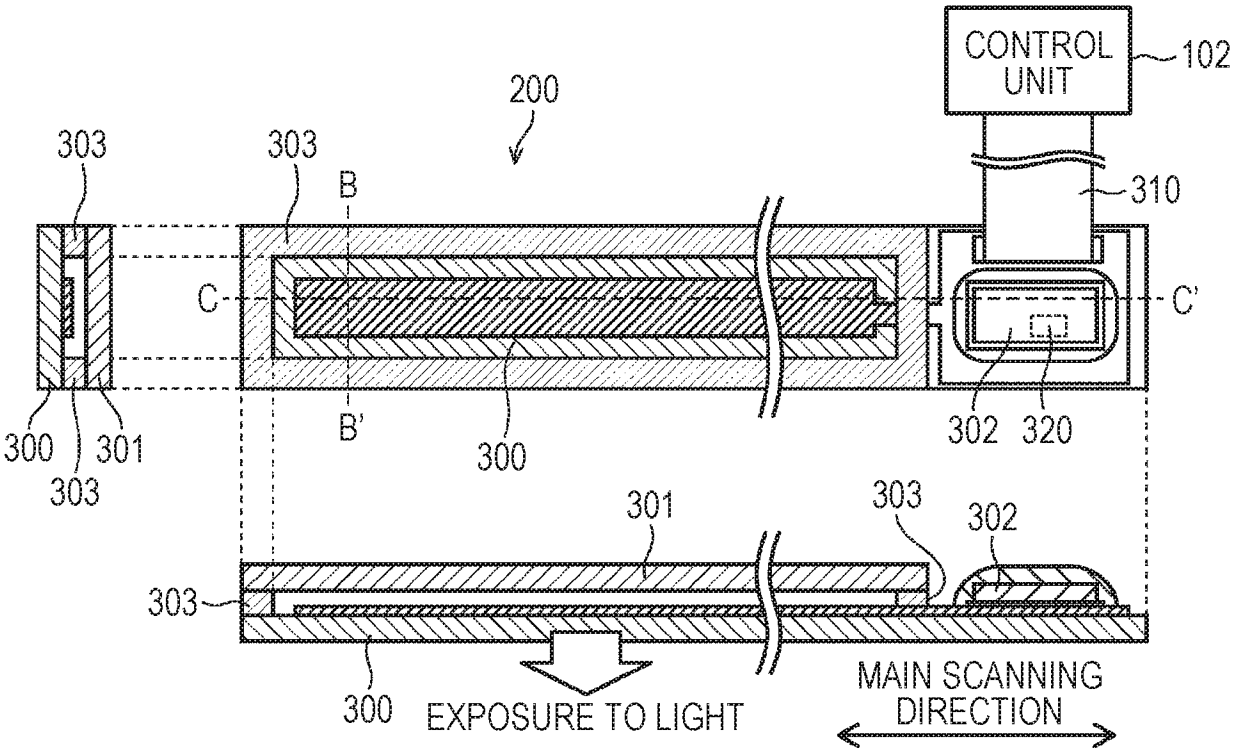
FIG. 3 is a schematic plan view of an OLED panel unit, and also illustrates a cross sectional view cut along line B-B' and a cross sectional view cut along line C-C'.

FIG. 3 is a schematic plan view of the OLED panel 200, and also illustrates a cross sectional view cut along line B-B' and a cross sectional view cut along line C-C'. The schematic plan view illustrates the OLED panel 200 from which a sealing plate 301 described below has been removed.

As illustrated in FIG. 3, the OLED panel 200 includes a TFT substrate 300, the sealing plate 301, a driver integrated circuit (IC) 302, and the like. On the TFT substrate 300, 15,000 OLEDs 201 are arranged in a main scanning direction in a line shape. These OLEDs 201 may be arranged in a line or in a zigzag as long as condensing points are arranged at a pitch of 21.2 μm (1200 dpi) on the outer peripheral surface of the photoreceptor drum 110.

A substrate surface of the TFT substrate 300 on which the OLEDs 201 are arranged is a sealing region, and the sealing plate 301 is attached thereto with a spacer frame body 303 interposed therebetween. The sealing region is thereby sealed while enclosing dry nitrogen or the like such that dry nitrogen or the like is not exposed to the outside air. A moisture absorbent may be also enclosed in the sealing region for moisture absorption. For example, the sealing plate 301 may be formed of sealing glass or a material other than glass.

The driver IC 302 is mounted on the TFT substrate 300 outside the sealing region. The controlling unit 102 inputs a digital luminance signal to the driver IC 302 through a flexible wire 310. The controlling unit 102 incorporates an application specific integrated circuit (ASIC) specialized for generating a digital luminance signal.

The driver IC 302 converts a digital luminance signal into an analog luminance signal (hereinafter, simply referred to as "luminance signal") and inputs the luminance signal to a driving circuit for each of the OLEDs 201. The driving circuit generates a driving current of each of the OLEDs 201 according to the luminance signal. The luminance signal may be a current signal or a voltage signal. The driver IC 302 incorporates a temperature sensor 320. The driver IC 302 is mounted on the TFT substrate 300 like the OLEDs 201. Therefore, a temperature T detected by the temperature sensor 320 is approximately the same as a temperature of the OLEDs 201 themselves.

Figure 4:
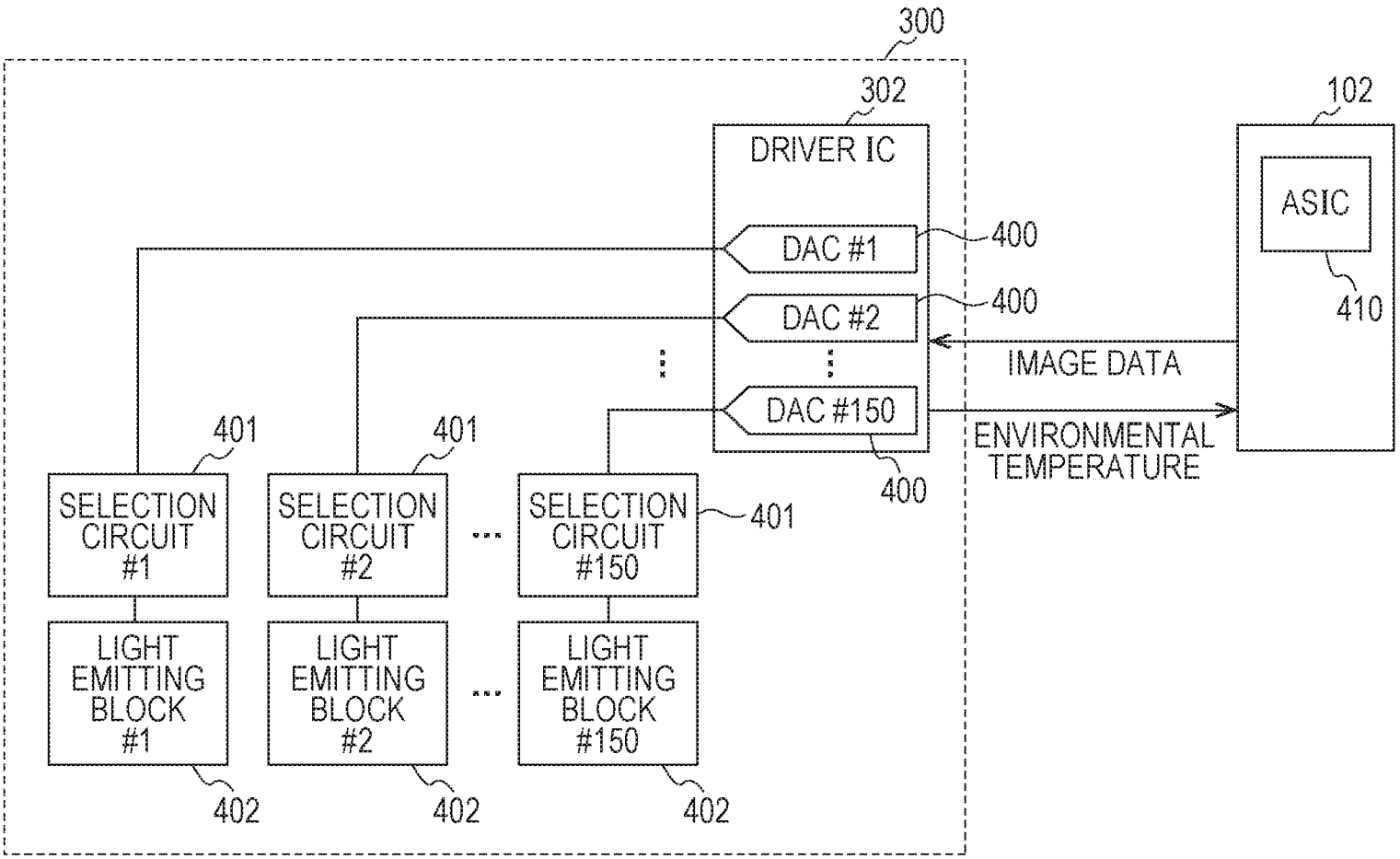
FIG. 4 is a block diagram illustrating a main structure of a TFT substrate.

As illustrated in FIG. 4, in the TFT substrate 300, 15,000 OLEDs 201 are divided into 150 light emitting blocks 402 each including 100 OLEDs 201. The driver IC 302 incorporates 150 DACs 400 each of which corresponds to each of the light emitting blocks 402 at one-to-one. Each of the DACs 400 is a variable voltage supply capable of being controlled digitally, and supplies a current while a specified voltage is maintained.

When a digital luminance signal (image data) is input to the driver IC 302 from an ASIC 410 incorporated in the controlling unit 102, 100 pixels of the input are distributed to each of the DACs 400 for one scanning period. The ASIC 410 acquires the temperature T detected by the temperature sensor 320 from the driver IC 302.

A selection circuit 401 is disposed on a circuit from each of the DACs 400 to each of the light emitting blocks 402. Each of the DACs 400 sequentially outputs a luminance signal to each of subordinate 100 OLEDs 201 by so-called rolling driving.

Figure 5:
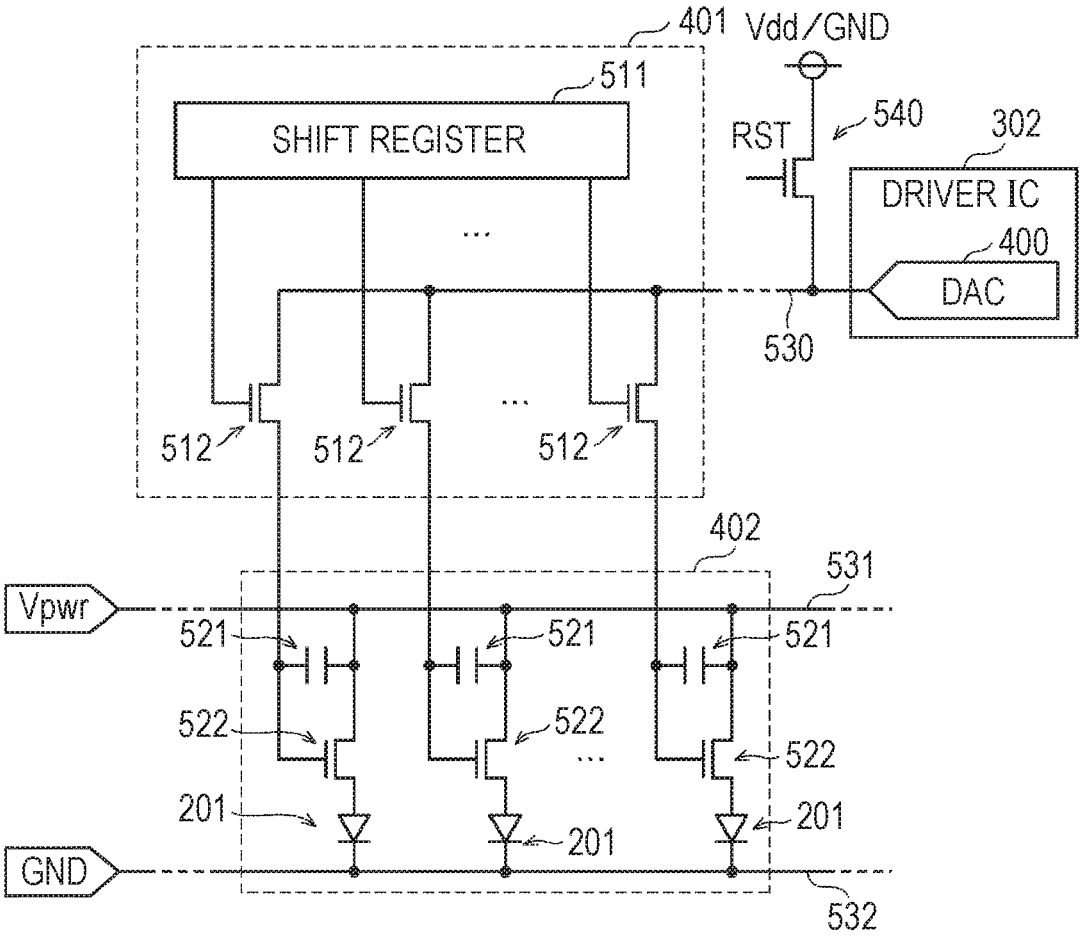
FIG. 5 is a circuit diagram illustrating main structures of a selection circuit and a light emitting block.

FIG. 5 is a circuit diagram illustrating a pair of the selection circuit 401 and the light emitting block 402. As illustrated in FIG. 5, the light emitting block 402 includes 100 light emitting pixel circuits each of which includes one capacitor 521, one driving TFT 522, and one of the OLEDs 201. The selection circuit 401 includes a shift register 511 and 100 selection TFTs 512.

The shift register 511 is connected to a gate terminal of each of the 100 selection TFTs 512, and sequentially turns the selection TFTs 512 on. A source terminal of each of the selection TFTs 512 is connected to each of the DACs 400 through a write-in wire 530, and a drain terminal thereof is connected to a first terminal of the capacitor 521 and a gate terminal of the driving TFT 522.

While the shift register 511 turns the selection TFTs 512 on, an output voltage of the DAC 400 is applied to the first terminal of the capacitor 521 to be held. The first terminal of the capacitor 521 is also connected to the gate terminal of the driving TFT 522. A second terminal of the capacitor 521 is connected to the source terminal of the driving TFT 522 and a power supply wire 531.

An anode terminal of the OLED 201 is connected to a drain terminal of the driving TFT 522. A cathode terminal of the OLED 201 is connected to a grounding wire 532. The power supply wire 531 is connected to a constant voltage supply Vpwr. The grounding wire 532 is connected to a grounding terminal GND.

The constant voltage supply Vpwr is a supply source of a driving current supplied to the OLED 201. The driving TFT 522 supplies a drain current corresponding to a voltage held between the first and second terminals of the capacitor 521 to the OLED 201 as a driving current. For example, when a signal corresponding to H is written in the capacitor 521, the driving TFT 522 is turned on and the OLED 201 emits light. When a signal corresponding to L is written in the capacitor 521, the driving TFT 522 is turned off and the OLED 201 does not emit light.

A reset circuit 540 is connected to the DAC 400. The reset circuit 540 may be incorporated in the driver IC 302, or a TFT may be used. The reset circuit 540 may switch a polarity of the DAC 400 between the time of reset and the time of write-in. When the reset circuit 540 is turned on, wires from the DAC 400 to the selection TFT 512 are reset to a predetermined voltage. This predetermined voltage may be a power supply voltage Vdd or a grounding voltage GND. Alternatively, the predetermined voltage may be a proper intermediate potential.

The present embodiment has exemplified a case where the driving TFT 522 is a p-channel, but of course the driving TFT 522 which is an n-channel may be used.

[3] Structure of ASIC 410

First, a structure of the ASIC 410 will be described.

Figures 6, 7:
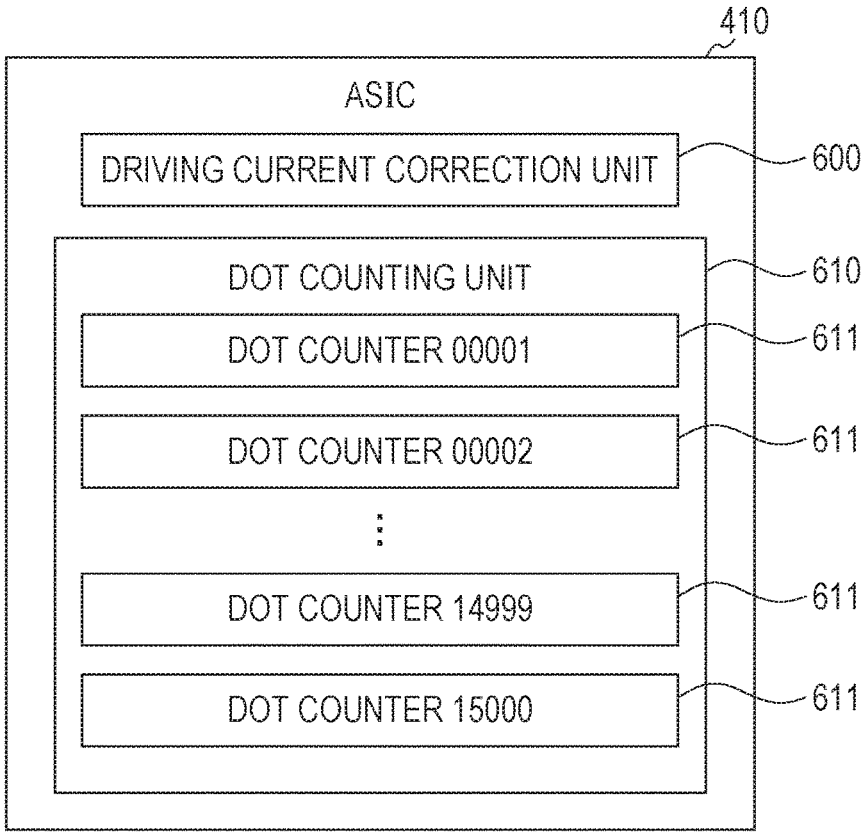
FIG. 6 is a block diagram illustrating a main structure of an ASIC.
FIG. 7 is a diagram exemplifying a set light quantity table stored in a driving current correction unit in the ASIC.

As illustrated in FIG. 6, the ASIC 410 includes a driving current correction unit 600 and a dot counting unit 610. The dot counting unit 610 includes a dot counter 611 for each of the OLEDs 201. The dot counter 611 increases the counting number by one when the OLED 201 corresponding thereto emits light once.

The driving current correction unit 600 stores six look up tables (LUTs) of a set light quantity table, an initial Vel table, a Vel correction coefficient table, an initial Id table, an Id correction coefficient table, and a TFT characteristic table.

(3-1) Set Light Quantity Table

As illustrated in FIG. 7, the set light quantity table is a table in which a set light quantity L has been recorded for each system speed for each of 15,000 OLEDs 201.

The set light quantity L is set in advance as a light quantity to be emitted by each of the OLEDs 201. The OLEDs 201 have different condensing ratios depending on a positional relation to the Selfoc lens array 202. Therefore, it is necessary to adjust the light quantity for each of the OLEDs 201 in order to make an exposed light quantity on an outer peripheral surface of the photoreceptor drum 110 the same. Therefore, the set light quantity L of one of the OLEDs 201 having a high condensing ratio is set to be small, and the set light quantity L of one of the OLEDs 201 having a low condensing ratio is set to be large.

The recording sheet S which is thick paper requires a larger heat quantity for fixing a toner image than the recording sheet S which is plain paper. Therefore, when a conveying speed (system speed) of the recording sheet S is switched according to the kind of paper of the recording sheet S, a rotation speed of the photoreceptor drum 110 at the time of exposure is also switched. Therefore, a difference is generated in exposure time per pixel.

In order to make an exposed light quantity per pixel the same regardless of the length of exposure time, the light quantity for each of the OLEDs 201 is adjusted. That is, the set light quantity in a case where the exposure time is long is set to be small, and the set light quantity in a case where the exposure time is short is set to be large.

Therefore, the set light quantity table stores the set light quantity L in a case where the system speed of the image forming device 1 is a full speed and the set light quantity L in a case where the system speed of the image forming device 1 is a half speed for each of the OLEDs 201. When the system speed is switched, the exposure time for each pixel is switched. Therefore, the exposed light quantity per pixel is made to be the same by switching the set light quantity L for each of the OLEDs 201.

In FIG. 7, the set light quantity L in a case where the system speed is a full speed and the set light quantity L in a case where the system speed is a half speed are stored for each of the OLEDs 201. Of course, the kind of the system speed is not limited to the two of the full speed and the half speed, but may be three or more.

(3-2) Initial Vel Table

The initial Vel table is a table storing an initial value of a forward direction voltage Vel of each of the 15,000 OLEDs 201 for each set light quantity L. The initial Vel table illustrated in FIG. 8A stores an initial value of the forward direction voltage Vel of each of the OLEDs 201 for each of four kinds of set light quantities Ls of A to D. Of course, the kind of the set light quantity L is not limited to four, but may be three or less or five or more.

(3-3) Vel Correction Coefficient Table

The Vel correction coefficient table is a table group provided for each temperature range. Each table stores a correction coefficient of a forward direction voltage Vel (hereinafter, referred to as "Vel correction coefficient") for each combination of a set light quantity of the OLED 201 and a range of an accumulated light emitting time E. The Vel correction coefficient table illustrated in FIG. 8B is provided for each of temperature ranges obtained by dividing temperatures of 0° C. to 80° C. into eight groups by ten degrees.

Each Vel correction coefficient table stores a Vel correction coefficient for each of four kinds of set light quantities of A to D for each time range obtained by dividing time of 0 hour to 1000 hours into 20 time ranges by 50 hours.

(3-4) Initial Id Table

The initial Vel table is a table storing an initial value of a driving current Id of each of the 15,000 OLEDs 201 for each set light quantity. The initial Id table illustrated in FIG. 9A stores an initial value of the driving current Id of each of the 15,000 OLEDs 201 for each of four kinds of set light quantities of A to D.

(3-5) Id Correction Coefficient Table

The Id correction coefficient table is a table group provided for each temperature range. Each table stores a correction coefficient of the driving current Id for each combination of a set light quantity of the OLED 201 and a range of an accumulated light emitting time E. The Id correction coefficient table illustrated in FIG. 9B is provided for each of temperature ranges obtained by dividing temperatures of 0° C. to 80° C. into eight groups by ten degrees.

Each Id correction coefficient table stores a driving current Id correction coefficient for each of four kinds of set light quantities of A to D for each time range obtained by dividing time of 0 hour to 1000 hours into 20 time ranges by 50 hours.

(3-6) TFT Characteristic Table

Figure 10:
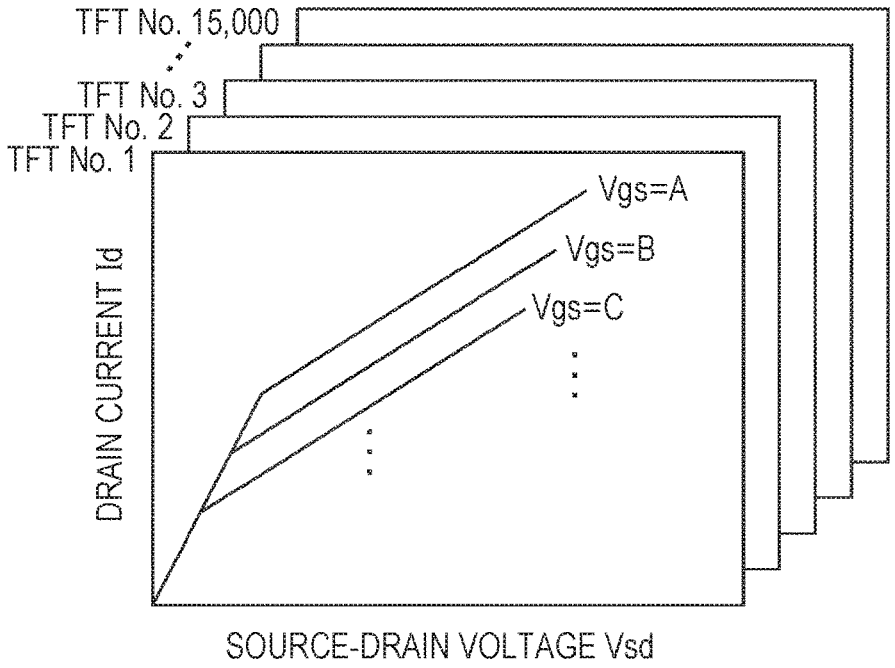
FIG. 10 is a graph for explaining a Vsd-Id characteristic for each TFT.
Figure 11:
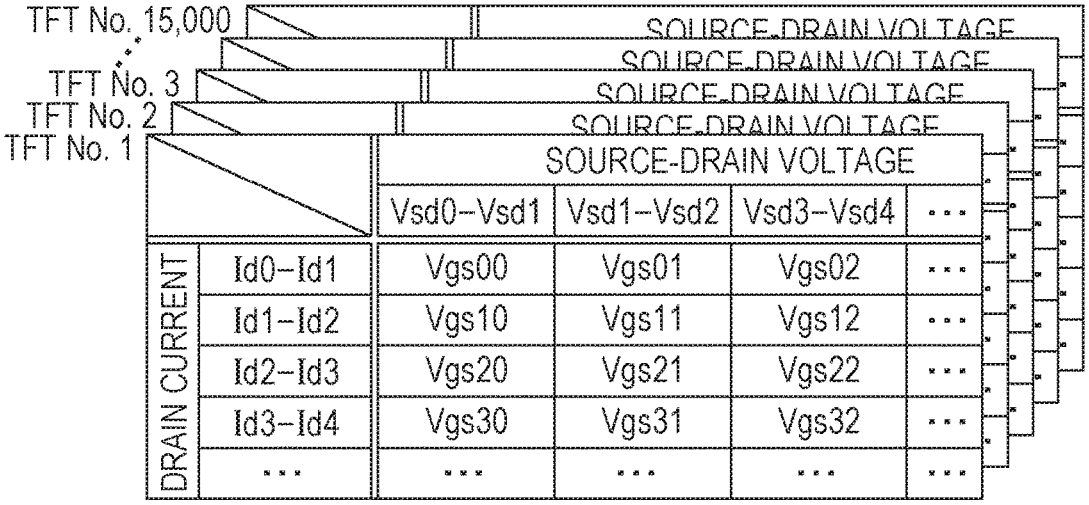
FIG. 11 is a diagram exemplifying a TFT characteristic table stored in the driving current correction unit in the ASIC.

The TFT characteristic table is provided for each of the 15,000 driving TFTs 522 provided for each of the OLEDs 201. Each TFT characteristic table stores a Vsd-Id characteristic (refer to FIG. 10) of the driving TFT 522 corresponding thereto for each gate-source voltage Vgs. Specifically, as illustrated in FIG. 11, the gate-source voltage Vgs is stored for each combination of a range of a source-drain voltage Vsd and a range of a drain current (driving current) Id.

As described below, by use of the TFT characteristic table, the gate-source voltage Vgs required for generating the driving current Id to cause the OLEDs 201 to emit light at a set light quantity can be specified.

[4] Action of ASIC 410

Next, an action of the ASIC 410 will be described.

The controlling unit 102 of the image forming device 1 determines a system speed depending on the kind of paper specified by a printing job when performing the printing job. When the image forming device 1 includes a plurality of paper feeding trays, the controlling unit 102 may determine the system speed depending on a paper feeding tray specified by the printing job.

The ASIC 410 refers to the system speed before the printing job is performed. The ASIC 410 performs processing illustrated in FIG. 12 every scanning of one line. That is, the ASIC 410 performs processing of steps S1201 to S1211 individually for all the OLEDs 201 every scanning of one line (S1200). Processing of the nth OLED 201 will be exemplified below.

First, the ASIC 410 refers to one of the dot counters 611 corresponding to the nth OLED 201 (S1201), calculates the accumulated light emitting time E (S1202), and refers to a temperature T detected by the temperature sensor 320 (S1203). The ASIC 410 refers to a set light quantity table stored in the driving current correction unit 600, and reads out a set light quantity corresponding to the system speed of the image forming device 1 of the set light quantities of the nth OLED 201 (S1204).

Subsequently, the ASIC 410 refers to the initial Vel table, acquires an initial Vel corresponding to the set light quantity (S1205), and acquires a Vel correction coefficient corresponding to the accumulated light emitting time E determined by referring to the Vel correction coefficient table, the detected temperature T, and the set light quantity (S1206).

The ASIC 410 multiplies the Vel correction coefficient by the initial Vel to estimate the forward direction voltage Vel as described in the following formula (1) (S1207).

$$\text{(forward direction voltage Vel)}=\text{(initial Vel)}\times\text{(Vel correction coefficient)} \quad (1)$$

The ASIC 410 further estimates the source-drain voltage Vsd from the forward direction voltage Vel as described in the following formula (2) (S1208).

$$\text{(source-drain voltage Vsd)}=\text{(constant voltage Vdd)}-\text{(forward direction voltage Vel)} \quad (2)$$

Subsequently, the ASIC 410 acquires an initial Id corresponding to the set light quantity determined by referring to the initial Id table (S1209), and acquires an Id correction coefficient corresponding to the accumulated light emitting time E determined by referring to the Id correction coefficient table, the detected temperature T, and the set light quantity (S1210). Then, the ASIC 410 estimates the driving current Id from these values as described in the following formula (3) (S1211).

$$\text{(driving current Id)}=\text{(initial Id)}\times\text{(Id correction coefficient)} \quad (3)$$

Figure 12:
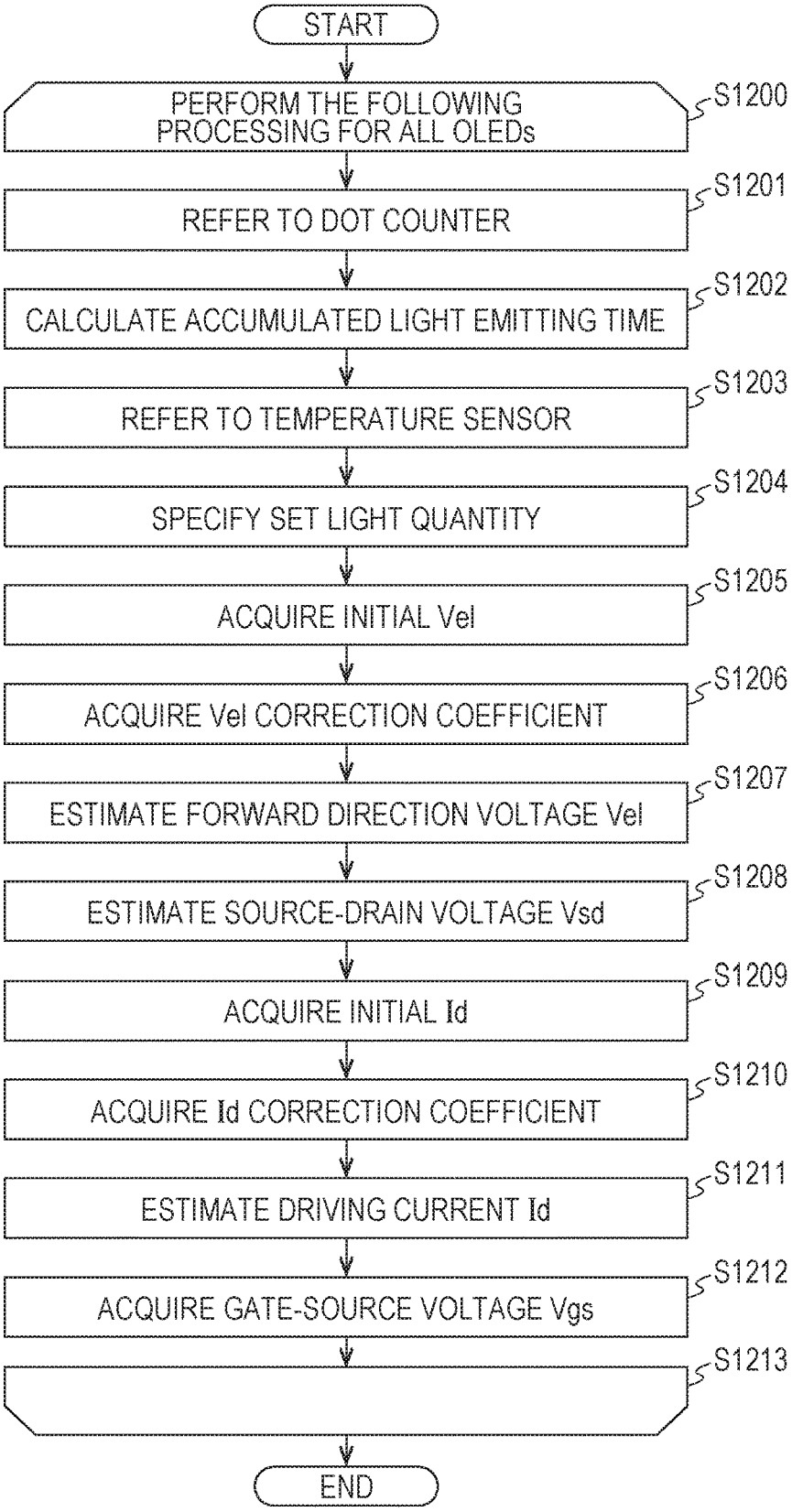
FIG. 12 is a flowchart illustrating an action of the ASIC.
Figure 13:
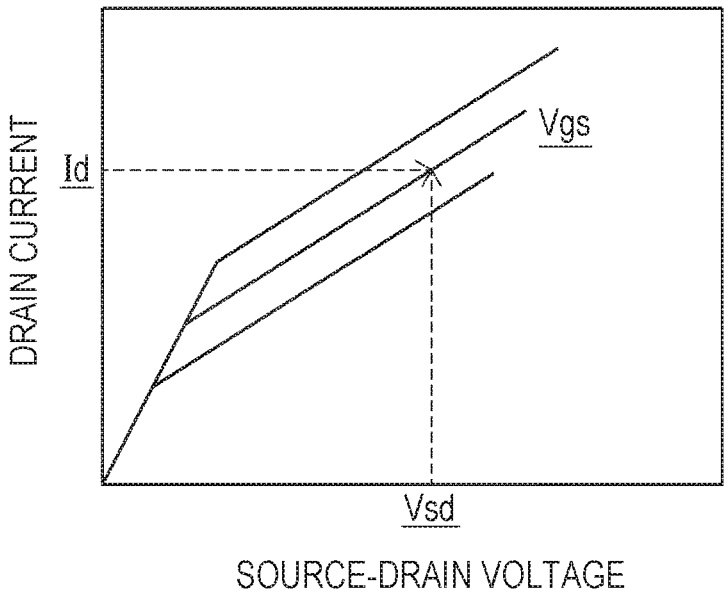
FIG. 13 is a graph for explaining an action for determining a gate-source voltage Vgs from a source-drain voltage Vsd and a drain current Id.
Figure 14B:
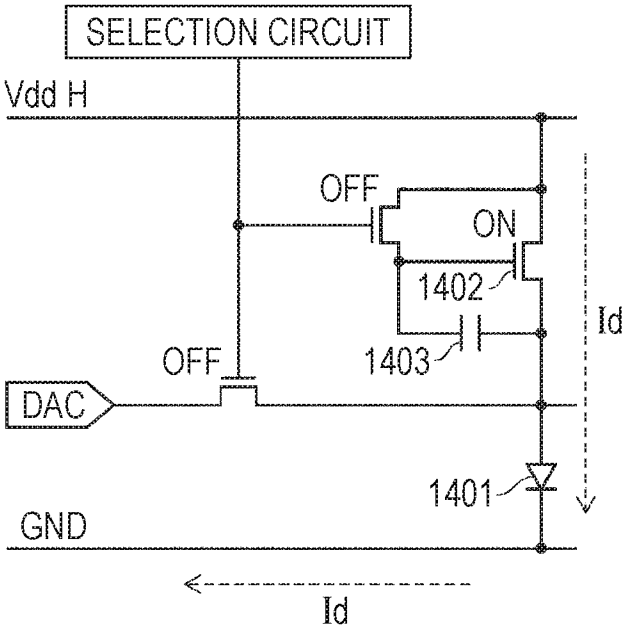
FIG. 14B is a diagram for explaining the action of the optical write-in device according to the conventional technology in a light emitting period.
Figure 14A:
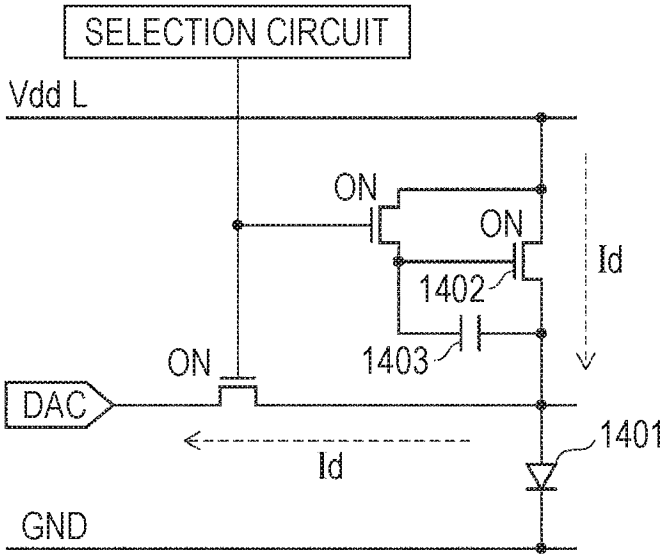
FIG. 14A is a diagram for explaining an action of an optical write-in device according to a conventional technology in a write-in period.

The ASIC 410 refers to the TFT characteristic table of the TFT 522, and acquires the gate-source voltage Vgs corresponding to the estimated source-drain voltage Vsd and driving current Id (S1212). As illustrated in FIG. 12, the gate-source voltage Vgs can be determined uniquely for each combination of the source-drain voltage Vsd and the drain current Id.

All the above processing is performed for all the OLEDs 201, and then the acquired gate-source voltage Vgs is input to each of the TFTs 522 to cause each of the OLEDs 201 to emit light.

By performing this, unevenness in a light quantity of the OLEDs 201 caused by an inclination can be suppressed even when the Vsd-Id characteristic graph of the TFT 522 is inclined in a so-called saturation region.

[5] Modification Example

Hereinabove, the present invention has been described based on embodiments. However, of course, the present invention is not limited to the above embodiments, but the following Modification Example can be performed.

(1) In the above embodiments, a case where the Vel correction coefficient is determined according to the accumulated light emitting time E, the detected temperature T, and the set light quantity of the OLED 201 has been exemplified. However, of course, an embodiment of the present invention is not limited thereto, but the Vel correction coefficient may be determined according to only one or two of the accumulated light emitting time E, the detected temperature T, and the set light quantity of the OLED 201. When another factor having an influence on a magnitude of the forward direction voltage Vel is present, the Vel correction coefficient may be determined using the factor.

Similarly, the Id correction coefficient may be determined according to only one or two of the accumulated light emitting time E, the detected temperature T, and the set light quantity of the OLED 201. When another factor having a large influence is present, the Id correction coefficient may be determined using the factor.

(2) In the above embodiments, a case where the forward direction voltage Vel or the drain current Id is estimated using the accumulated light emitting time E, the detected temperature T, and the set light quantity of the OLED 201 with reference to the initial Vel table and the Vel correction coefficient table has been exemplified. However, of course, an embodiment of the present invention is not limited thereto, but the forward direction voltage Vel or the drain current Id may be estimated using a function parameters of which are the accumulated light emitting time E, the detected temperature T, and the set light quantity of the OLED 201. A measured value of the forward direction voltage Vel may be used in place of estimating the forward direction voltage Vel.

(3) In the above embodiments, a case where a dot count for each of the OLEDs 201 is converted into accumulated light emitting time has been exemplified. However, of course, an embodiment of the present invention is not limited thereto, but the dot count may be used as it is in place of the accumulated light emitting time. In this case, a column of the accumulated light emitting time in the Vel correction coefficient table or the Id correction coefficient table becomes the dot count, and a correction coefficient corresponding to a range of the dot count is stored in place of a range of the accumulated light emitting time.

(4) In the above embodiments, a case where the temperature T detected by the temperature sensor 320 incorporated in the driver IC 302 is assumed to be a temperature of the OLED 201 itself has been exemplified. However, of course, an embodiment of the present invention is not limited thereto, but an index to indicate the temperature of the OLED 201 itself may be acquired by another method. For example, an environmental temperature around the OLED 201 may be acquired as the index. As long as an index has a fixed proportional relation to the temperature of the OLED 201 itself, the same effect of an embodiment of the present invention is obtained by use of the index.

(5) In the above embodiments, a case where the detection temperature of the temperature sensor 320 is referred to every scanning of one line has been exemplified. However, of course, an embodiment of the present invention is not limited thereto, but the detection temperature may be referred to every operation of one recording sheet or may be referred to in a job unit in place of this when it is clear that the temperature of the OLED 201 is not rapidly varied. The detection temperature may be referred to every fixed time. In any case, the same effect of an embodiment of the present invention is obtained.

(6) In the above embodiments, a case where the Vel correction coefficient table (FIG. 8B) stores a correction coefficient of the forward direction voltage Vel for each range of accumulated light emitting time has been exemplified, and a case where the Id correction coefficient table (FIG. 9B) stores a correction coefficient of the driving current Id for each range of accumulated light emitting time has been exemplified. However, of course, an embodiment of the present invention is not limited thereto, but the following may be performed in place of this.

For example, in place of the range of accumulated light emitting time, a correction coefficient may be stored at a predetermined time interval such as an interval of 50 hours, and a correction coefficient value in other accumulated light emitting time may be calculated by linear interpolation using a correction coefficient stored in the tables.

The TFT characteristic table (FIG. 11) may also store a gate-source voltage Vgs for each source-drain voltage Vsd at a predetermined interval in place of a range of a source-drain voltage Vsd, and another source-drain voltage Vsd may be calculated by linear interpolation using a gate-source voltage Vgs corresponding to a source-drain voltage Vsd stored in the table.

In any case, of course, an interpolation method other than linear interpolation may be used.

(7) In the above embodiments, a case where the image forming device 1 is a tandem type color printer has been exemplified. However, of course, an embodiment of the present invention is not limited thereto, but the image forming device 1 may be a color printer which is not a tandem type or a monochrome printer. The image forming device 1 may be a copying device provided with a scanner or a facsimile device further provided with a facsimile communication function. Even when an embodiment of the present invention is applied to a multi-function peripheral (MFP) provided with these functions, a similar effect can be obtained.

A light emitting device, an optical write-in device, and an image forming device according to an embodiment of the present invention are useful as devices for controlling a light quantity of a light emitting element driven by a current using a thin film transistor with a high accuracy.

According to an embodiment of the present invention, the gate-source voltage Vgs is determined according to the Vsd-Id characteristic of the thin film transistor. Therefore, the light quantity of the OLED can be constant regardless of the Vsd-Id characteristic in a non-saturation region.

The light emitting device preferably includes a temperature detecting unit for acquiring an index to indicate a temperature of an OLED as a factor and a time measuring unit for measuring accumulated light emitting time for the OLED as a factor individually. A forward direction voltage estimating unit preferably estimates a forward direction voltage of the OLED according to at least one of the accumulated light emitting time of the OLED, the temperature thereof, and the set light quantity thereof.

In this case, the forward direction voltage estimating unit preferably estimates the forward direction voltage of the OLED by multiplying a correction coefficient according to at least one of the accumulated light emitting time of the OLED, the temperature thereof, and the set light quantity thereof by an initial value of the forward direction voltage of the OLED.

The forward direction voltage estimating unit preferably stores a LUT or a function for estimating the correction coefficient according to at least one of the accumulated light emitting time of the OLED, the temperature thereof, and the set light quantity thereof, and preferably estimates the correction coefficient using the LUT or the function.

The light emitting device preferably includes a temperature detecting unit for acquiring an index to indicate a temperature of the OLED as a factor and a time measuring unit for measuring accumulated light emitting time for the OLED as a factor individually. A driving current amount estimating unit preferably estimates a driving current amount of the OLED according to at least one of the accumulated light emitting time of the OLED, the temperature thereof, and the set light quantity thereof.

The driving current amount estimating unit preferably estimates the driving current amount of the OLED according to at least one of the accumulated light emitting time of the OLED, the temperature thereof, and the set light quantity thereof.

In this case, the driving current amount estimating unit preferably estimates the forward direction voltage of the OLED by multiplying a correction coefficient according to at least one of the accumulated light emitting time of the OLED, the temperature thereof, and the set light quantity thereof by an initial value of the driving current amount of the OLED.

The driving current amount estimating unit preferably stores a LUT or a function for estimating the correction coefficient according to at least one of the accumulated light emitting time of the OLED, the temperature thereof, and the set light quantity thereof, and preferably estimates the correction coefficient using the LUT or the function.

The temperature detecting unit preferably detects an environmental temperature of the OLED or a temperature of a substrate on which the OLED is mounted as the index.

The optical write-in device according to an embodiment of the present invention is an optical write-in device which performs optical write-in by making a photoreceptor exposed to light, and includes a plurality of the light emitting devices according to an embodiment of the present invention and a light condensing unit for condensing light emitted from the OLED on the photoreceptor, characterized in that the OLEDs are arranged in a line shape.

An image forming device according to an embodiment of the present invention is characterized in including the optical write-in device according to an embodiment of the present invention. In this case, the image forming device preferably includes a set light quantity switching unit for switching a set light quantity according to a system speed.

Although the present invention has been described and illustrated in detail, it is clearly understood that the same is by way of illustrated and example only and is not to be taken by way of limitation, the scope of the present invention being interpreted by terms of the appended claims.

What is claimed is:

1. A light emitting device configured to cause a series circuit in which an OLED is connected to a thin film transistor to emit light by applying a predetermined voltage to the thin film transistor, comprising:

a forward direction voltage estimating unit configured to estimate a forward direction voltage in a case in which the OLED is caused to emit light at a set light quantity, according to a factor that changes an element characteristic of the OLED;

a driving current amount estimating unit configured to estimate a driving current amount required to cause the OLED to emit light at the set light quantity, according to the factor that changes the element characteristic of the OLED;

a source-drain voltage calculating unit configured to calculate a source-drain voltage (Vsd) of the thin film transistor from the predetermined voltage and the forward direction voltage; and a gate-source voltage determining unit configured to determine a gate-source voltage (Vgs) of the thin film transistor corresponding to the source-drain voltage (Vsd) in a case in which the driving current amount is a drain current (Id) according to a Vsd-Id characteristic representing a relation between the source-drain voltage (Vsd) of the thin film transistor and the drain current (Id), wherein the light emitting device causes the OLED to emit light by applying the determined gate-source voltage (Vgs) to the thin film transistor.

2. The light emitting device according to claim 1, further comprising:

a temperature detecting unit configured to acquire an index indicating a temperature of the OLED; and a time measuring unit configured to measure an individual accumulated light emitting time for the OLED, wherein the forward direction voltage estimating unit estimates the forward direction voltage of the OLED according to, as the factor, at least one of the accumulated light emitting time of the OLED, the temperature of the OLED, and the set light quantity of the OLED.

3. The light emitting device according to claim 2, wherein the forward direction voltage estimating unit estimates the forward direction voltage of the OLED by multiplying (i) a correction coefficient according to the at least one of the accumulated light emitting time of the OLED, the temperature of the OLED, and the set light quantity of the OLED by (ii) an initial value of the forward direction voltage of the OLED.

4. The light emitting device according to claim 3, wherein the forward direction voltage estimating unit stores a lookup table (LUT) or a function for estimating the correction coefficient according to the at least one of the accumulated light emitting time of the OLED, the temperature of the OLED, and the set light quantity of the OLED, and estimates the correction coefficient using the LUT or the function.

5. The light emitting device according to claim 2, wherein the driving current amount estimating unit estimates the driving current amount of the OLED according to, as the factor, at least one of the accumulated light emitting time of the OLED, the temperature of the OLED, and the set light quantity of the OLED.

6. The light emitting device according to claim 5, wherein the driving current amount estimating unit estimates the driving current amount of the OLED by multiplying (i) a correction coefficient according to the at least one of the accumulated light emitting time of the OLED, the temperature of the OLED, and the set light quantity of the OLED by (ii) an initial value of the driving current amount of the OLED.

7. The light emitting device according to claim 6, wherein the driving current amount estimating unit stores a lookup table (LUT) or a function for estimating the correction coefficient according to the at least one of the accumulated light emitting time of the OLED, the temperature of the OLED, and the set light quantity of the OLED, and estimates the correction coefficient using the LUT or the function.

8. The light emitting device according to claim 2, wherein the temperature detecting unit detects an environmental temperature of the OLED or a temperature of a substrate on which the OLED is mounted, as the index.

9. The light emitting device according to claim 1, comprising:

a temperature detecting unit configured to acquire an index indicating a temperature of the OLED; and a time measuring unit configured to measure an individual accumulated light emitting time for the OLED, wherein the driving current amount estimating unit estimates the driving current amount of the OLED according to, as the factor, at least one of the accumulated light emitting time of the OLED, the temperature of the OLED, and the set light quantity of the OLED.

10. The light emitting device according to claim 9, wherein the driving current amount estimating unit estimates the driving current amount of the OLED by multiplying (i) a correction coefficient according to the at least one of the accumulated light emitting time of the OLED, the temperature of the OLED, and the set light quantity of the OLED by (ii) an initial value of the driving current amount of the OLED.

11. The light emitting device according to claim 10, wherein the driving current amount estimating unit stores a lookup table (LUT) or a function for estimating the correction coefficient according to the at least one of the accumulated light emitting time of the OLED, the temperature of the OLED, and the set light quantity of the OLED, and estimates the correction coefficient using the LUT or the function.

12. The light emitting device according to claim 9, wherein the temperature detecting unit detects an environmental temperature of the OLED or a temperature of a substrate on which the OLED is mounted, as the index.

13. An optical write-in device configured to perform optical write-in by exposing a photoreceptor to light, comprising:

a plurality of the light emitting devices according to claim 1; and a light condensing unit configured to condense light emitted from the OLEDs on the photoreceptor, wherein the OLEDs are arranged in a line shape.

14. An image forming device comprising the optical write-in device according to claim 13.

15. The image forming device according to claim 14, wherein the image forming device is operable at a plurality of different system speeds, and wherein the image forming device further comprises a set light quantity switching unit configured to switch the set light quantity according to the different system speeds.

16. The light emitting device according to claim 1, further comprising:

a temperature detecting unit configured to acquire an index indicating a temperature of the OLED; and a time measuring unit configured to measure an individual accumulated light emitting time for the OLED, wherein the forward direction voltage estimating unit estimates the forward direction voltage of the OLED according to, as the factor, at least two of the accumulated light emitting time of the OLED, the temperature of the OLED, and the set light quantity of the OLED.

17. The light emitting device according to claim 1, further comprising:

a temperature detecting unit configured to acquire an index indicating a temperature of the OLED; and a time measuring unit configured to measure an individual accumulated light emitting time for the OLED, wherein the forward direction voltage estimating unit estimates the forward direction voltage of the OLED according to, as the factor, the accumulated light emitting time of the OLED, the temperature of the OLED, and the set light quantity of the OLED.

18. The light emitting device according to claim 1, comprising:

a temperature detecting unit configured to acquire an index indicating a temperature of the OLED; and a time measuring unit configured to measure an individual accumulated light emitting time for the OLED, wherein the driving current amount estimating unit estimates the driving current amount of the OLED according to, as the factor, at least two of the accumulated light emitting time of the OLED, the temperature of the OLED, and the set light quantity of the OLED.

19. The light emitting device according to claim 1, comprising:

a temperature detecting unit configured to acquire an index indicating a temperature of the OLED; and a time measuring unit configured to measure an individual accumulated light emitting time for the OLED, wherein the driving current amount estimating unit estimates the driving current amount of the OLED according to, as the factor, the accumulated light emitting time of the OLED, the temperature of the OLED, and the set light quantity of the OLED.

* * * * *